US009233482B2

(12) United States Patent
Wallgren

(10) Patent No.: US 9,233,482 B2
(45) Date of Patent: Jan. 12, 2016

(54) SHEARING PADDLES IN A DRUM MIXER FOR HIGH SLUMP CONCRETE

(71) Applicant: Mark E. Wallgren, King City (CA)

(72) Inventor: Mark E. Wallgren, King City (CA)

( * ) Notice: Subject to any disclaimer, the term of this patent is extended or adjusted under 35 U.S.C. 154(b) by 372 days.

(21) Appl. No.: 13/788,374

(22) Filed: Mar. 7, 2013

(65) Prior Publication Data

US 2014/0254301 A1 Sep. 11, 2014

(51) Int. Cl.
*B28C 5/20* (2006.01)
*B01F 9/06* (2006.01)

(52) U.S. Cl.
CPC ..... *B28C 5/2054* (2013.01); *B01F 9/06* (2013.01)

(58) Field of Classification Search
CPC ..... B28C 5/2054
USPC ..... 366/44, 57–59
See application file for complete search history.

(56) References Cited

U.S. PATENT DOCUMENTS 1,801,162 A * 4/1931 Jaeger ..... 366/44
1,934,116 A 11/1933 Canfield
3,879,020 A 4/1975 Ray
4,187,028 A 2/1980 Pawley
4,188,127 A 2/1980 Pawley
4,268,174 A 5/1981 Falardeau
4,403,865 A * 9/1983 Fejmert ..... 366/44
4,752,134 A 6/1988 Milek
4,787,938 A 11/1988 Hawkins

FOREIGN PATENT DOCUMENTS

CN 101648407 6/2011
JP 53165273 12/1978

* cited by examiner

*Primary Examiner* — David Sorkin
(74) *Attorney, Agent, or Firm* — Ryan W. Dupuis; Kyle R. Satterthwaite; Ade & Company Inc.

(57) ABSTRACT

A batch mixer for mixing concrete materials into a mixed concrete includes a mixing drum having a plurality of paddles fixed to the drum for rotation with the mixing drum about the longitudinal axis of the mixing drum. The paddles include mixing paddles oriented to urge the concrete materials away from the outlet opening at the second end of the drum when the mixing drum is rotated in the mixing direction, and at least one shearing paddle which is oriented at less than 25 degrees from the longitudinal direction of the mixing drum. The shearing paddles has a main body portion interrupted by shearing apertures through which concrete material are directed and an inner edge which is discontinuous and interrupted by longitudinally spaced teeth.

20 Claims, 5 Drawing Sheets

SHEARING PADDLES IN A DRUM MIXER FOR HIGH SLUMP CONCRETE

FIELD OF THE INVENTION

The present invention relates to an improved paddle configuration for use in a drum concrete mixer, and more particularly the present invention relates to shearing paddles which are particularly suited for mixing high slump concrete.

BACKGROUND

Concrete is commonly mixed in batches in a drum batch mixer, including tilting and non-tilting drum mixers.

One typical configuration of a non-tilting reversing drum mixer includes a horizontally oriented cylindrical drum having an inlet opening at a first end for charging the mixer with concrete materials to be mixed, an outlet opening at an opposing second end for discharging mixed concrete from the drum, and a plurality of mixing paddles supported in the drum to extend generally radially inwardly from the cylindrical wall of the drum for mixing concrete as the drum is rotated. The mixing paddles are oriented to urge the concrete materials towards the inlet opening when the mixing drum is rotated in a first mixing direction and to urge the concrete materials towards the outlet opening when the mixing drum is rotated in a second discharging direction.

Alternatively, in some instances of non-tilting drum mixers, the inlet opening and discharge opening may be located at the same end of the drum. In this instance the mixing paddles are oriented to urge the concrete materials away from the discharge opening when the mixing drum is rotated in a first mixing direction and to urge the concrete materials towards the outlet opening when the mixing drum is rotated in a second discharging direction.

A known desirable feature of reversing drum mixers is that the mixing paddles are substantially self-cleaning after each batch of concrete being mixed because the mixing paddles are typically specifically designed with smooth surfaces terminating at smooth continuous inner free edges while being oriented at a relative steep inclination of approximately 35-45 degrees to the longitudinal axis of the drum. This paddle configuration ensures that the concrete materials readily slide off of the paddles during mixing and discharging.

In tilting drum mixers, the drum axis is typically oriented near horizontal for mixing with paddles oriented to urge material away from the discharge opening at the discharge end of the drum to retain the concrete materials in the drum while mixing. The drum is then tilted so that the drum axis is oriented at a downward inclination towards the discharge opening for discharging. It remains desirable for the mixing paddles to have smooth surfaces to avoid excess accumulation of concrete materials thereon when discharging.

Occasionally when mixing high slump concrete using typical mixing paddles as described above, pockets of unmixed material remain in the concrete materials being mixed. These pockets of unmixed material are difficult to break up due to the high fluidity of the mixture and due to the design of the paddles which are intended to be substantially self-cleaning with smooth edges, smooth surfaces, and sharp inclinations relative to the longitudinal axis of the mixer as noted above with regard to reversing drum mixers for example.

SUMMARY OF THE INVENTION

According to one aspect of the invention there is provided a batch mixer for mixing concrete materials into a mixed concrete, the batch mixer comprising:

a mixing drum comprising a generally cylindrical peripheral wall surrounding a hollow interior extending in a longitudinal direction between a first end and a second end and being arranged to receive concrete materials to be mixed therein;

a first end wall at the first end of the mixing drum;

a second end wall at the second end of the mixing drum defining an outlet opening therein arranged to discharge the concrete materials from the hollow interior of the mixing drum therethrough;

a drive arranged to selectively rotate the mixing drum about a longitudinal axis thereof in either a first direction, or a second direction opposite to the first direction; and a plurality of paddles, each comprising a main body portion supported in fixed relation to the mixing drum to extend generally radially inwardly from the peripheral wall towards respective inner edges and so as to be arranged for rotation with the mixing drum about the longitudinal axis of the mixing drum;

the plurality of paddles being oriented to urge the concrete materials towards the first end of the drum when the mixing drum is rotated in the first direction and to urge the concrete materials towards the outlet opening at the second end of the drum when the mixing drum is rotated in the second direction opposite to the first direction; and the plurality of paddles including at least one mixing paddle and at least one shearing paddle different in configuration than said at least one mixing paddle;

said at least one shearing paddle comprising a plurality of teeth at longitudinally spaced positions along the respective inner edge of the main body portion to project inwardly towards the longitudinal axis of the mixing drum.

According to a second aspect of the present invention there is provided a batch mixer for mixing concrete materials into a mixed concrete comprising a plurality of paddles including at least one mixing paddle and at least one shearing paddle having a plurality of shearing apertures formed in the main body portion at spaced apart positions in the longitudinal direction. Preferably a minimum dimension of each mixing aperture between opposing edges thereof is equal to or less than a largest allowable chunk size in the mixed concrete.

In a preferred embodiment, the teeth and the shearing apertures are both commonly located on intermediate ones of the mixing paddles in the batch mixer. The gaps between adjacent teeth and the shearing apertures encourage the flow of high slump concrete materials therethrough such that larger pockets of material interact with the edges of the teeth and the edges of the apertures to be more readily broken up.

According to another aspect of the present invention there is provided a batch mixer for mixing concrete materials into a mixed concrete comprising a plurality of paddles including at least one mixing paddle and at least one shearing paddle which is oriented at less than 25 degrees from the longitudinal direction of the mixing drum, wherein at least one of the main body portion or the inner edge of said at least one shearing paddle is discontinuous and interrupted at a plurality of longitudinally spaced locations, for example by locating shearing apertures in the main body portion or by locating teeth on the inner edge.

More preferably, the inclination of the paddles is near to or slightly less than 20 degrees from the longitudinal direction, or in even further embodiments, the paddles may be substantially closer to 0 degrees. By providing a shallow angle on the paddles relative to the longitudinal axis, the concrete materials are less likely to slide longitudinally off of the opposing ends of the paddles.

The longitudinal sliding of the concrete materials resulting from a steep inclination on the paddles is desirable for ensuring the paddles remain substantially self-cleaning when mixing low slump concrete. However when mixing highly fluid, high slump concrete a shallow inclination of the paddles, for example 10 degrees from the longitudinal axis of the drum, encourages more concrete material to be forced over the toothed outer edge or through the shearing apertures in the paddle surface, thus increasing the opportunity for pockets of unmixed material to be more readily broken up.

According to another aspect of the present invention there is provided a batch mixer for mixing concrete materials into a mixed concrete, the batch mixer comprising:

a mixing drum comprising a generally cylindrical peripheral wall surrounding a hollow interior extending in a longitudinal direction between a first end and a second end and being arranged to receive concrete materials to be mixed therein;

a first end wall at the first end of the mixing drum;

a second end wall at the second end of the mixing drum defining an outlet opening therein arranged to discharge the concrete materials from the hollow interior of the mixing drum therethrough;

a drive arranged to selectively rotate the mixing drum about a longitudinal axis thereof in a mixing direction; and a plurality of paddles, each comprising a main body portion supported in fixed relation to the mixing drum to extend generally radially inwardly relative to the peripheral wall towards respective inner edges and so as to be arranged for rotation with the mixing drum about the longitudinal axis of the mixing drum;

the plurality of paddles including at least one mixing paddle oriented to urge the concrete materials away from the outlet opening at the second end of the drum when the mixing drum is rotated in the mixing direction; and the plurality of paddles including at least one shearing paddle which is oriented at less than 25 degrees from the longitudinal direction of the mixing drum;

wherein at least one of the main body portion or the inner edge of the main body portion of said at least one shearing paddle is discontinuous and interrupted at a plurality of longitudinally spaced locations.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
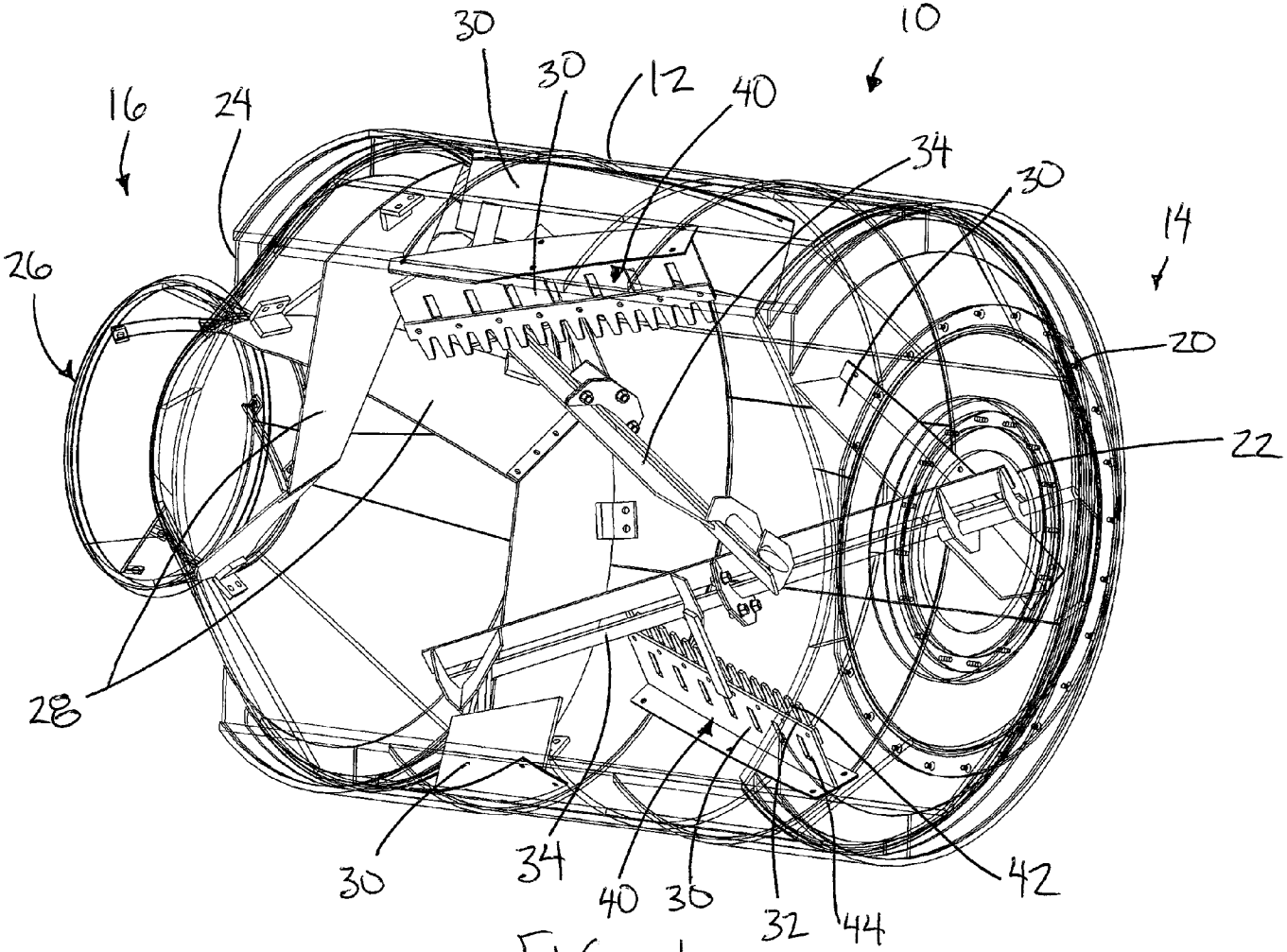
FIG. 1 is a partly sectional perspective view from the inlet end of the reversing drum concrete mixer.
Figure 2:
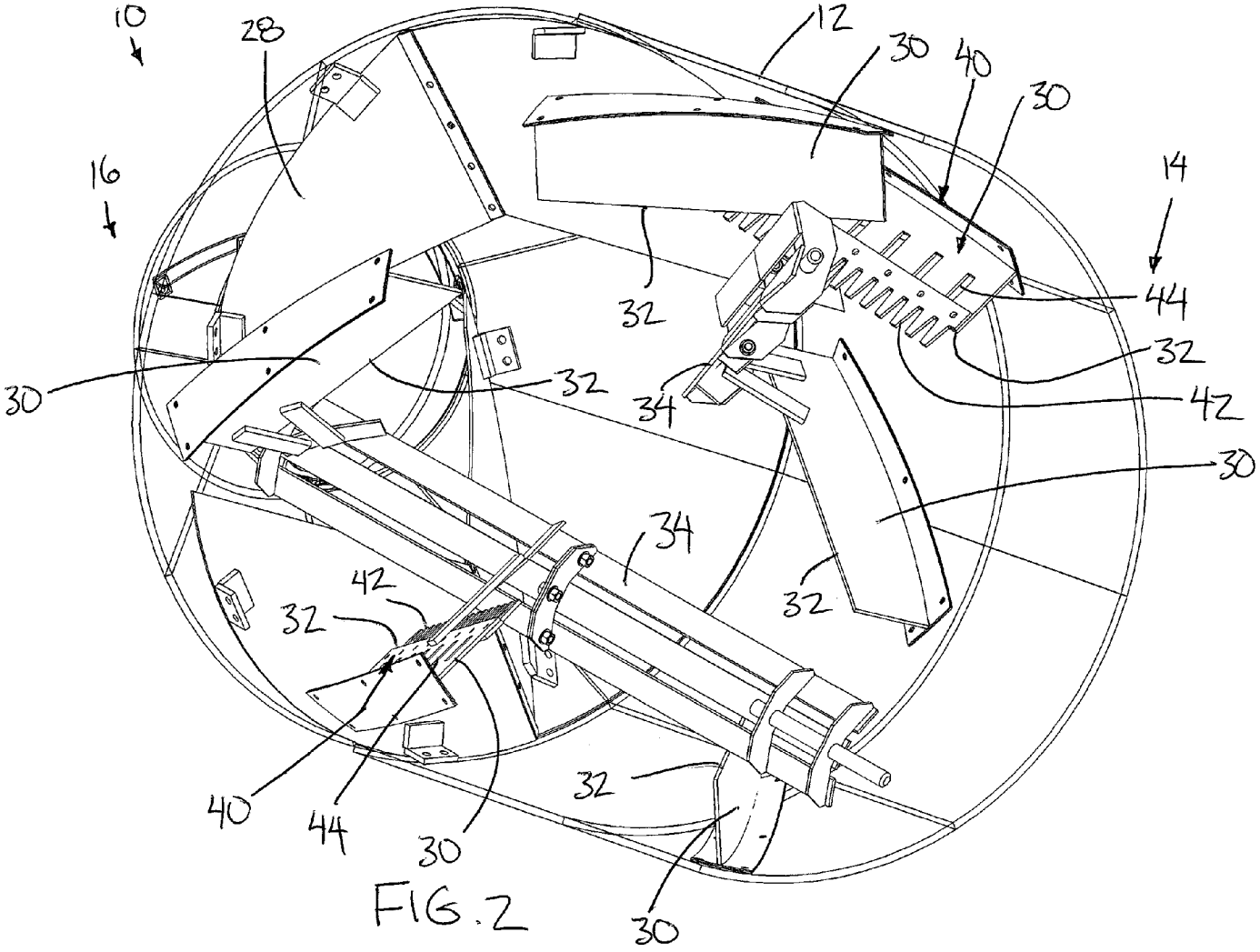
FIG. 2 is a perspective view of the mixing and shearing paddles within the interior of the drum with the inlet end and a portion of the peripheral wall of the drum shown removed.
Figure 3:
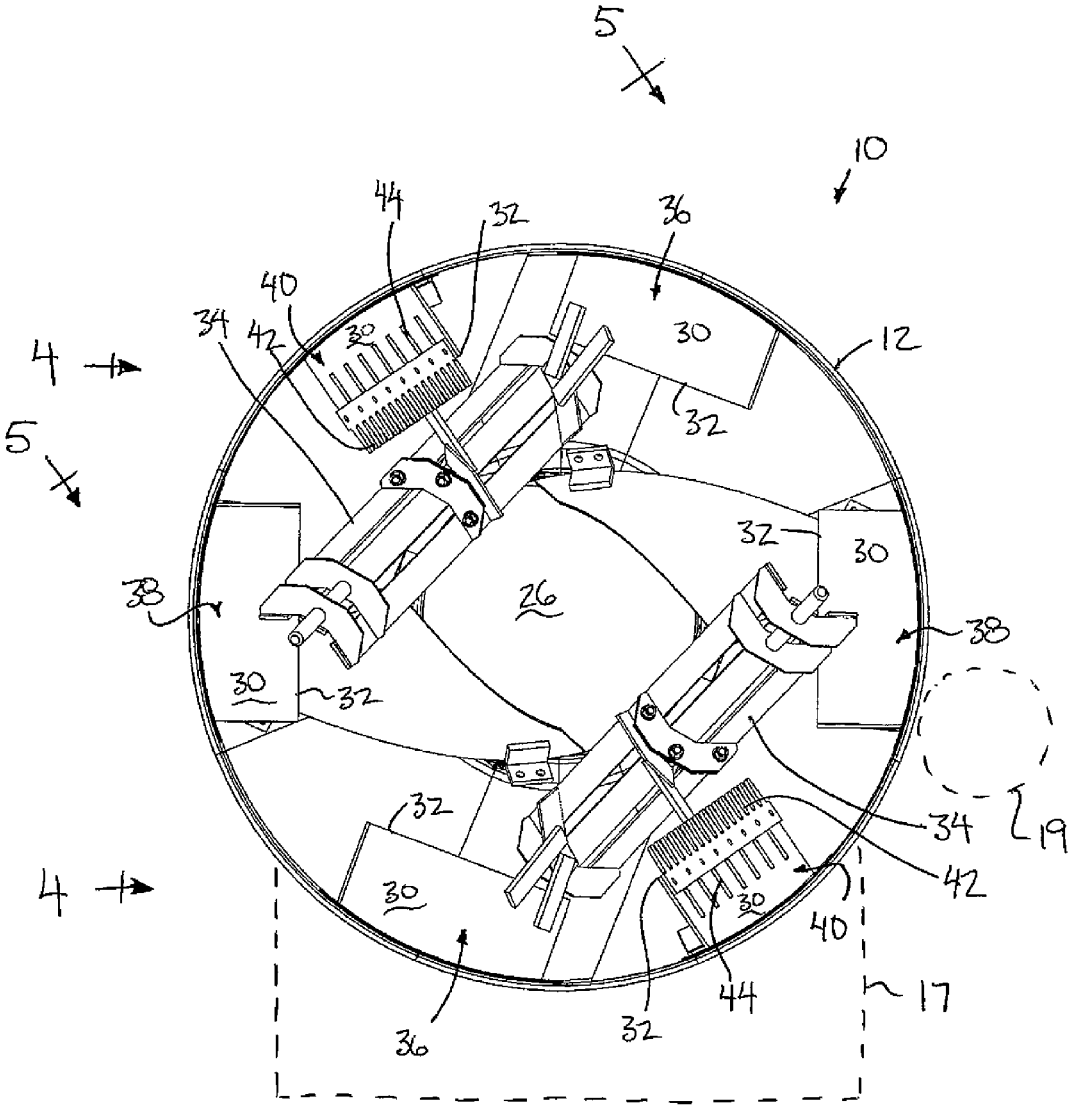
FIG. 3 is an end elevational view of the mixer with the inner end wall shown removed.
Figure 4:
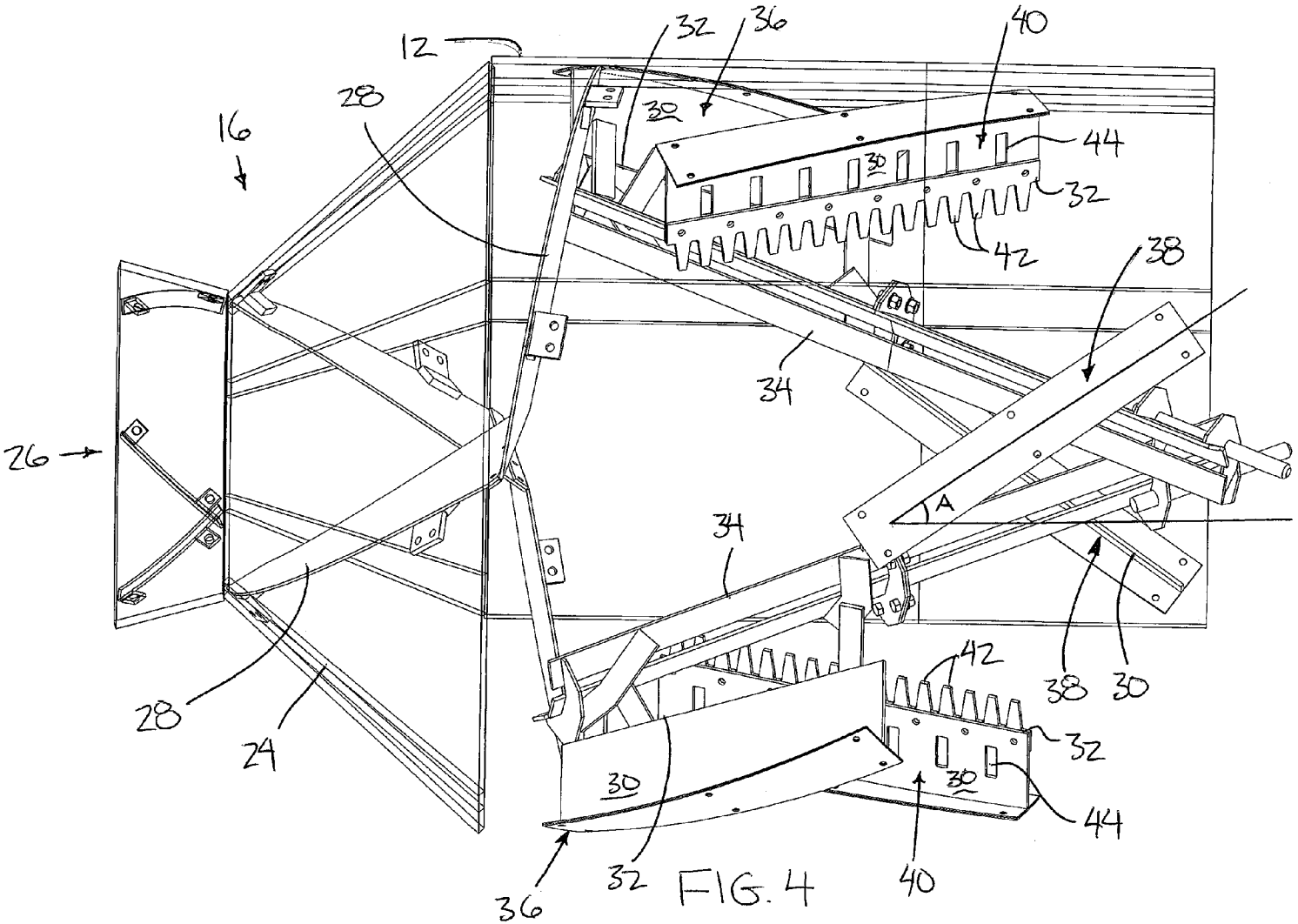
FIG. 4 is an elevational view with portions of the peripheral wall shown removed as seen from the direction of line 4-4 in FIG. 3.
Figure 5:
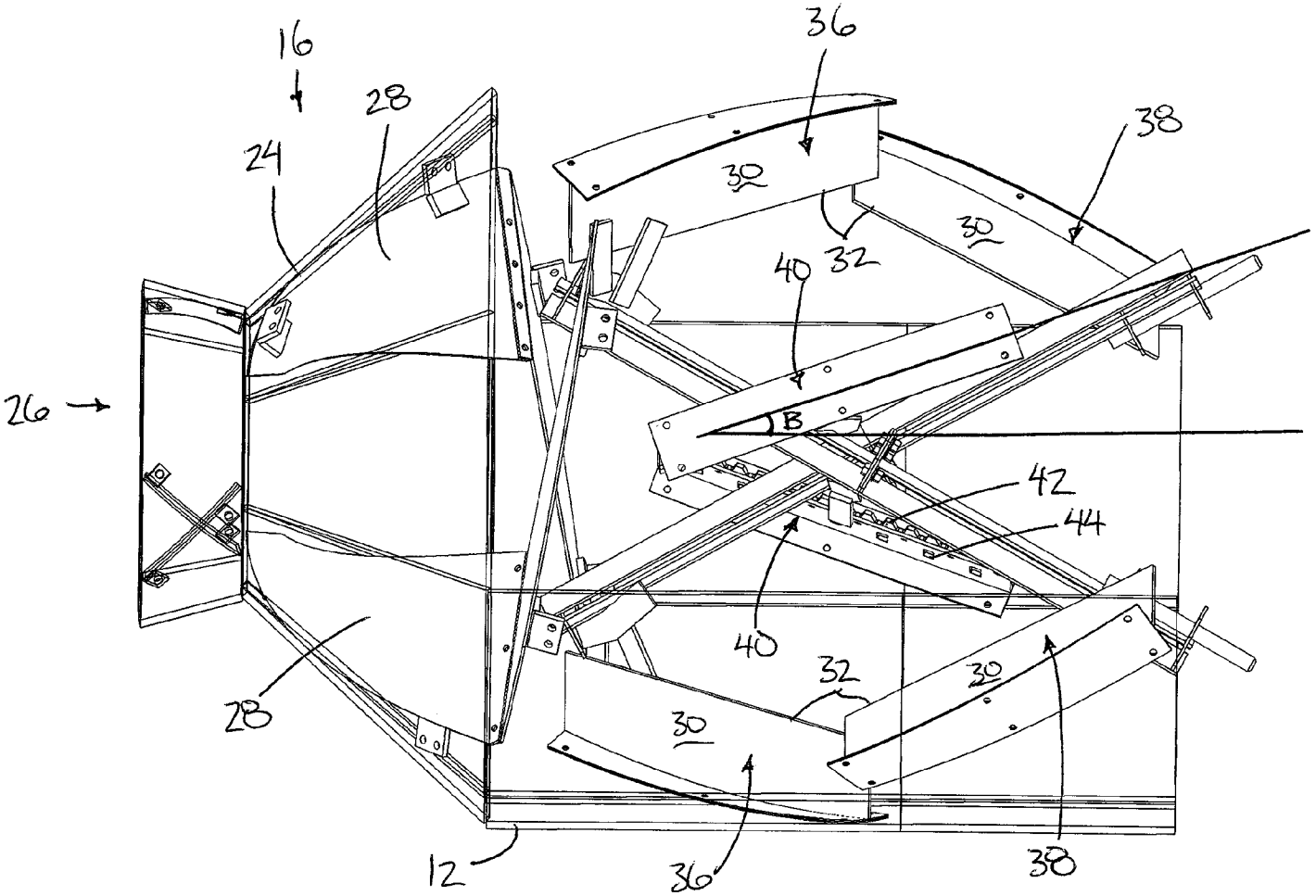
FIG. 5 is an elevational view of the drum with a portion of the peripheral wall shown removed as seen from the direction of line 5-5 in FIG. 3.

Referring to the accompanying figures, there is illustrated a batch concrete drum mixer generally indicated by reference numeral 10. The mixer 10 of the illustrated embodiment is a reversing drum mixer for mixing concrete materials into a mixed concrete therein.

The mixer 10 generally includes a mixer drum 12 having a cylindrical peripheral wall which surrounds a hollow interior of the drum. The peripheral wall extends generally horizontally in the longitudinal direction between an inlet end 14 and an opposing outlet end 16 of the drum.

The drum is supported on a suitable frame 17 for rotation about a longitudinal axis of the drum which is horizontally oriented. A majority of the peripheral wall of the drum 12 is defined by a main cylindrical portion which defines the longitudinal axis of the drum. A drive 19 engages the drum to operate the drum either in a mixing mode in which the drum is rotated about the longitudinal axis in a first mixing direction and a discharging mode in which the drum is rotated about the longitudinal axis in an opposing second discharge direction opposite to the mixing direction.

The drum further includes a first end wall 20 which spans the inlet and encloses the first end of the hollow interior. The first end wall locates an inlet opening 22 centrally therein for alignment with a charging chute to permit concrete materials to be received through the inlet opening from the charging chute for charging the mixing drum with the concrete materials to be mixed.

A second end wall 24 spans the outlet end and encloses the opposing second end of the hollow interior. The second end wall 24 is generally conical to extend longitudinally outward as it tapers centrally inward to a central discharge opening 26 through which the mixed concrete materials can be discharged. Discharge shovels 28 are fixed to the inner side of the second end wall and serve to gather and guide the mixed concrete material towards the central discharge opening with the drum is rotated about the longitudinal axis in the discharge direction.

A plurality of paddles are mounted within the hollow interior by being fixedly supported on the peripheral wall 16 at various longitudinal and circumferentially spaced positions relative to one another. Each paddle comprises a generally rectangular main body portion 30 which is formed of rigid flat sheet metal and which is fixed to the peripheral wall at a respective outer edge to extend generally radially inward therefrom to a respective free inner edge 32 of the main body portion. All of the paddles are joined to the peripheral wall at an inclination offset from the longitudinal direction. Although the paddles are offset at different inclinations, they are all offset in a common direction so as to be suitably arranged to urge the concrete materials from the outlet end towards the inlet end when rotated in the mixing direction. Similarly, all paddles urge the mixed concrete materials in an opposing direction from the inlet end towards the discharge shovels at the outlet end when rotated in the discharge direction.

A set of longitudinal slides 34 at evenly circumferentially spaced positions are also mounted within the hollow interior. Each slide comprises a set of longitudinally extending flat strips positioned generally alongside one another to form an elongate trough shape. Each slide is mounted at a location spaced radially inward from the peripheral wall at an inclination to the longitudinal direction. The resulting longitudinal slides are generally sloped in orientation and span substantially the full length in a generally conventional manner. The slides serve to capture material falling into the drum from the inlet opening when charging or to capture some material which falls radially inward from the inner edges of the mixing paddles to slide some of the captured material from the inlet end towards the outlet end when rotated in the mixing direction so that the material may again be urged by the mixing paddles at the peripheral wall back towards the inlet.

The paddles include two or more outlet mixing paddles 36 at evenly spaced positions in the circumferential direction adjacent the outlet end of the drum in the longitudinal direction. The paddles also include two or more inlet mixing paddles 38 which are similarly evenly spaced in the circumferential direction from one another but longitudinally spaced from the outlet paddles so as to be located adjacent the inlet end of the drum. The inlet paddles are also circumferentially offset from the outlet paddles.

The paddles further include two or more intermediate shearing paddles 40 which are also evenly spaced apart from one another in a circumferential direction about the drum and which are centered in the longitudinal direction between the pair of inlet paddles and the pair of outlet paddles. Accordingly, the intermediate paddles are offset longitudinally from the inlet paddles at the inlet end and the outlet paddles at the outlet end which are instead nearer to the inlet and outlet ends of the drum than the intermediate paddles respectively. The intermediate paddles are also circumferentially offset from both the inlet and outlet paddles.

Each of the inlet and outlet mixing paddles comprises a substantially uniform panel having an uninterrupted planar surface spanning from the outer edge to the inner free edge. The inner edge remains continuous and linear so as to be uninterrupted in the longitudinal direction along a full length of the paddle. Each of the inlet and outlet mixing paddles is also oriented at an angle from the longitudinal direction which may be approximately 35 to 45 degrees. In this instance, when rotated in the mixing direction, some of the material is folded over the inner edge in a radially inward direction, however a substantial portion of the concrete to be mixed is longitudinally displaced in a sliding direction with the inclination of the paddle towards the inlet end of the drum.

The two intermediate shearing paddles 40 comprise irregular paddles which are both toothed and perforated so as to have discontinuous and interrupted surfaces and inner edges as described in further detail below.

More particularly each of the two intermediate paddles 40 includes a plurality of teeth 42 which are mounted at longitudinally spaced positions along the inner edge. Each tooth projects radially inward beyond the inner edge of the main body portion of the paddle with a tapering width in the longitudinal direction of the drum as they extend radially inward. The radial dimension of each tooth projecting radially inward beyond the inner edge of the main body portion of the paddle is approximately 25-50% for example near ⅓ of the radial dimension of the paddle between the inner and outer edges of the main body portion for example. At the inner free ends of each tooth, the width as measured in the longitudinal direction of the drum is approximately equal to the space between each adjacent pair of teeth also measured in the longitudinal direction of the drum at the inner free end. The width of the teeth and the space between the teeth is uniform across each paddle.

Each intermediate shearing paddle 40 further comprises a plurality of shearing apertures 44 which are formed in the main body portion at longitudinally spaced positions therealong. Each mixing aperture is elongate in the radial direction having a radial dimension which is equal to half or less of the radial dimension of the paddle between the inner and outer edges thereof. The shearing apertures are radially centered between the inner and outer edges of each paddle such that the apertures are spaced radially inward from the outer edges of the paddle fixed onto the peripheral wall of the drum.

In the illustrated embodiment, the width of each mixing aperture as measured in the longitudinal direction of the drum is approximately equal to half of the length of the aperture in the radial direction while the apertures are spaced apart sufficiently from one another that the space measured in the longitudinal direction of the drum between each adjacent pair of apertures is more than double the corresponding dimension of the aperture in the illustrated embodiment. The size of each tooth is approximately equal in area to the area of each mixing aperture. Typically, a minimum dimension of each mixing aperture between opposing edges thereof, such as the width in the illustrated embodiment, is equal to or less than a largest allowable chunk size in the mixed concrete.

In further embodiments, the shearing apertures may be formed by a plurality of parallel and spaced apart bars spanning across a common opening in the main body of the panel, so that each shearing aperture is defined between an adjacent pair of bars to fully span across the common opening in the paddle. The width of each shearing aperture between adjacent bars in this instance may be greater than the width of each bar.

In each embodiment, each of the intermediate paddles 40 is an irregular paddle in that it is interrupted along its inner edge by the teeth as well as having planar side surfaces which are interrupted between the inner and outer edges by the shearing apertures, although in further embodiments, the intermediate paddles may only comprise teeth or only comprise shearing apertures.

The outer edges of each paddle are fixed to the peripheral wall such that the main body portion of the paddle is inclined relative to the longitudinal direction of the drum at an inclination typically less than 25 degrees, and more particularly 18 degrees in the illustrated embodiment for example. In further instances, the inclination can be much less, for example in the range of 5 to 10 degrees.

The shallow angle encourages less concrete material to be longitudinally displaced along the surface of the paddle by the inclination of the paddle from the longitudinal direction and instead is more likely to encourage material to flow over the inner edge where the teeth are located or through the apertures in the main body portion due to the material being encouraged to dwell longer on the surface of each paddle as it is rotated up the side of the drum during operation. The increased interaction of the concrete materials with the apertures and the teeth along the inner edge of each paddle are thus well suited for breaking up clumps of concrete materials to be mixed within the drum, particularly when mixing a high slump concrete.

In further embodiments the size and orientation of the teeth and shearing apertures, as well as the location and orientation of the shearing paddles relative to the mixing paddles can be changed without substantially affecting the ability of the shearing paddles to break up chunks of concrete material to be mixed. For example, the width of each aperture may be equal to the space between adjacent apertures in some embodiments.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A batch mixer for mixing high slump materials, the batch mixer comprising:

a mixing drum comprising a generally cylindrical peripheral wall surrounding a hollow interior extending in a longitudinal direction between a first end and a second end and being arranged to receive high slump materials to be mixed therein;

a first end wall at the first end of the mixing drum;

a second end wall at the second end of the mixing drum defining an outlet opening therein arranged to discharge the high slump materials from the hollow interior of the mixing drum therethrough;

a drive arranged to selectively rotate the mixing drum about a longitudinal axis thereof in either a first direction, or a second direction opposite to the first direction; and a plurality of paddles, each comprising a main body portion supported in fixed relation to the mixing drum to extend generally radially inwardly from the peripheral wall towards respective inner edges and so as to be arranged for rotation with the mixing drum about the longitudinal axis of the mixing drum;

the plurality of paddles being oriented to urge the high slump materials towards the first end of the drum when the mixing drum is rotated in the first direction and to urge the high slump materials towards the outlet opening at the second end of the drum when the mixing drum is rotated in the second direction opposite to the first direction; and the plurality of paddles including at least one mixing paddle and at least one shearing paddle different in configuration than said at least one mixing paddle;

said at least one shearing paddle comprising a plurality of teeth at longitudinally spaced positions along the respective inner edge of the main body portion to project inwardly towards the longitudinal axis of the mixing drum to respective inner free ends which are spaced apart in a longitudinal direction of the paddle from one another so as to define a space extending in the longitudinal direction between each adjacent pair of teeth.

2. The batch mixer according to claim 1 wherein the teeth project inwardly beyond the inner edge of the main body portion of said at least one shearing paddle by a radial dimension corresponding to 25% to 50% of a radial dimension of the main body portion.

3. The batch mixer according to claim 1 wherein the space between each adjacent pair of the teeth is approximately equal to a width of the teeth at the inner free ends.

4. The batch mixer according to claim 1 wherein said at least one shearing paddle is supported on the peripheral wall at an intermediate location spaced longitudinally inward from both the inlet end and the outlet end of the mixing drum.

5. The batch mixer according to claim 1 wherein said at least one mixing paddle comprises a uniform paddle in which the inner edge is continuous and uninterrupted in the longitudinal direction.

6. The batch mixer according to claim 5 wherein there is provided a plurality of shearing paddles and a plurality of mixing paddles supported in the hollow interior of the mixing drum.

7. The batch mixer according to claim 1 wherein said at least one shearing paddle is oriented at less than 25 degrees from the longitudinal direction of the mixing drum.

8. The batch mixer according to claim 1 wherein at least one of the paddles includes shearing apertures formed in the main body portion at spaced apart positions in the longitudinal direction, the shearing apertures being spaced inward in a radial direction from the peripheral wall of the drum.

9. The batch mixer according to claim 8 wherein said at least one shearing paddle includes the shearing apertures formed in the main body portion thereof.

10. A batch mixer for mixing high slump materials, the batch mixer comprising:

a mixing drum comprising a peripheral wall surrounding a hollow interior extending in a longitudinal direction between a first end and a second end and being arranged to receive high slump materials to be mixed therein, the peripheral wall including a cylindrical portion defining a longitudinal axis of the mixing drum;

a first end wall at the first end of the mixing drum;

a second end wall at the second end of the mixing drum defining an outlet opening therein arranged to discharge the high slump materials from the hollow interior of the mixing drum therethrough;

a frame supporting the mixing drum thereon for rotation about the longitudinal axis of the mixing drum such that the longitudinal axis is horizontally oriented;

a drive arranged to selectively rotate the mixing drum about the longitudinal axis thereof in either a first direction, or a second direction opposite to the first direction; and a plurality of paddles, each comprising a main body portion supported in fixed relation to the mixing drum to extend generally radially inwardly from the peripheral wall towards respective inner edges and so as to be arranged for rotation with the mixing drum about the longitudinal axis of the mixing drum;

the plurality of paddles being oriented to urge the high slump materials towards the first end of the drum when the mixing drum is rotated in the first direction and to urge the high slump materials towards the outlet opening at the second end of the drum when the mixing drum is rotated in the second direction opposite to the first direction; and the plurality of paddles which are independent and spaced apart from one another such that each paddle only extends a portion of a length of the mixing drum in the longitudinal direction, the plurality of paddles including at least one mixing paddle and at least one shearing paddle different in configuration than said at least one mixing paddle;

said at least one shearing paddle comprising a plurality of shearing apertures formed in the main body portion at spaced apart positions in the longitudinal direction;

said at least one mixing paddle comprising an uninterrupted surface which is devoid of apertures between an outer edge fixed to the peripheral wall and the inner edge thereof;

said at least one mixing paddle including a first mixing paddle in proximity to the first end of the mixing drum and a second mixing paddle in proximity to the second end of the mixing drum.

11. The batch mixer according to claim 10 wherein a minimum dimension of each shearing aperture between opposing edges thereof is equal to or less than a largest allowable chunk size in the high slump material.

12. The batch mixer according to claim 10 wherein a length of each shearing aperture in the radial direction is less than half a radial dimension of the shearing paddle between the peripheral wall and the inner edge of the shearing paddle.

13. The batch mixer according to claim 10 wherein said at least one shearing paddle that includes shearing apertures formed therein is oriented at less than 25 degrees from the longitudinal direction of the mixing drum.

14. The batch mixer according to claim 10 wherein at least one of the mixing paddles comprises a uniform paddle having an uninterrupted surface between an outer edge fixed to the peripheral wall and the inner edge.

15. A batch mixer for mixing high slump materials, the batch mixer comprising:

a mixing drum comprising a generally cylindrical peripheral wall surrounding a hollow interior extending in a longitudinal direction between a first end and a second end and being arranged to receive high slump materials to be mixed therein;

a first end wall at the first end of the mixing drum;

a second end wall at the second end of the mixing drum defining an outlet opening therein arranged to discharge the high slump materials from the hollow interior of the mixing drum therethrough;

a drive arranged to selectively rotate the mixing drum about a longitudinal axis thereof in a mixing direction; and a plurality of paddles, each comprising a main body portion supported in fixed relation to the mixing drum to extend generally radially inwardly relative to the peripheral wall towards respective inner edges and so as to be arranged for rotation with the mixing drum about the longitudinal axis of the mixing drum;

the plurality of paddles including at least one mixing paddle oriented to urge the high slump materials away from the outlet opening at the second end of the drum when the mixing drum is rotated in the mixing direction; and the plurality of paddles including at least one shearing paddle which is oriented at less than 25 degrees from the longitudinal direction of the mixing drum;

wherein the main body portion of said at least one shearing paddle is discontinuous and interrupted at a plurality of longitudinally spaced locations by at least one of i) spaces in a longitudinal direction of the paddle between teeth which project inwardly towards the longitudinal axis of the mixing drum to respective inner free ends which are spaced apart from one another in said longitudinal direction of the paddle, and ii) a plurality of shearing apertures formed in the main body portion at spaced apart positions in the longitudinal direction.

16. The batch mixer according to claim 15 wherein said at least one shearing paddle is oriented at less than 20 degrees from the longitudinal direction of the mixing drum.

17. The batch mixer according to claim 15 wherein said at least one shearing paddle is oriented at 5 to 10 degrees from the longitudinal direction of the mixing drum.

18. The batch mixer according to claim 15 wherein said at least one mixing paddle is oriented at an angle from the longitudinal direction of the mixing drum which is greater than an angle from the longitudinal direction of the mixing drum of said at least one shearing paddle.

19. A batch mixer for mixing high slump materials, the batch mixer comprising:

a mixing drum comprising a peripheral wall surrounding a hollow interior extending in a longitudinal direction between a first end and a second end and being arranged to receive high slump materials to be mixed therein, the peripheral wall including a cylindrical portion defining a longitudinal axis of the mixing drum;

a first end wall at the first end of the mixing drum;

a second end wall at the second end of the mixing drum defining an outlet opening therein arranged to discharge the high slump materials from the hollow interior of the mixing drum therethrough;

a frame supporting the mixing drum thereon for rotation about the longitudinal axis of the mixing drum such that the longitudinal axis is horizontally oriented;

a drive arranged to selectively rotate the mixing drum about the longitudinal axis thereof in either a first direction, or a second direction opposite to the first direction; and a plurality of paddles, each comprising a main body portion supported in fixed relation to the mixing drum to extend generally radially inwardly from the peripheral wall towards respective inner edges and so as to be arranged for rotation with the mixing drum about the longitudinal axis of the mixing drum;

the plurality of paddles being oriented to urge the high slump materials towards the first end of the drum when the mixing drum is rotated in the first direction and to urge the high slump materials towards the outlet opening at the second end of the drum when the mixing drum is rotated in the second direction opposite to the first direction; and the plurality of paddles which are independent and spaced apart from one another such that each paddle only extends a portion of a length of the mixing drum in the longitudinal direction, the plurality of paddles including at least one mixing paddle and at least one shearing paddle different in configuration than said at least one mixing paddle;

said at least one shearing paddle comprising a plurality of shearing apertures formed in the main body portion at spaced apart positions in the longitudinal direction;

said at least one mixing paddle comprising an uninterrupted surface which is devoid of apertures between an outer edge fixed to the peripheral wall and the inner edge thereof;

said at least one mixing paddle is oriented at an angle from the longitudinal direction of the mixing drum which is greater than an angle from the longitudinal direction of the mixing drum of said at least one shearing paddle.

20. The batch mixer according to claim 19 wherein a shape of each shearing aperture is elongate in one direction.

* * * * *